US012716215B2

(12) United States Patent
Ni et al.

(10) Patent No.: US 12,716,215 B2
(45) Date of Patent: Aug. 25, 2026

(54) LOCKING MECHANISM FOR INSTALLING FAUCET ABOVE COUNTERTOP

(71) Applicant: CLEMENT INC., Flushing, NY (US)

(72) Inventors: Changzheng Ni, Xiamen (CN); Chunhua Wang, Xiamen (CN); Yongqiang Yan, Xiamen (CN)

(73) Assignee: CLEMENT INC., Flushing, NY (US)

( * ) Notice: Subject to any disclaimer, the term of this patent is extended or adjusted under 35 U.S.C. 154(b) by 101 days.

(21) Appl. No.: 18/885,634

(22) Filed: Sep. 14, 2024

(65) Prior Publication Data

US 2026/0078571 A1 Mar. 19, 2026

(51) Int. Cl.
*E03C 1/04* (2006.01)

(52) U.S. Cl.
CPC ..... *E03C 1/0402* (2013.01)

(58) Field of Classification Search
CPC .... E03C 1/0401; E03C 1/0402; E03C 1/0403; E03C 2001/0416; Y10T 137/6977
See application file for complete search history.

(56) References Cited

U.S. PATENT DOCUMENTS

| | | | | |
|---|---|---|---|---|
| 7,269,864 | B2 * | 9/2007 | Brown | E03C 1/0401 4/678 |
| 7,698,755 | B2 * | 4/2010 | McNerney | E03C 1/0401 4/695 |
| 7,979,929 | B2 * | 7/2011 | Vogel | E03C 1/0401 4/695 |
| 11,859,373 | B2 * | 1/2024 | Chen | E03C 1/0402 |

FOREIGN PATENT DOCUMENTS

| | | | | |
|---|---|---|---|---|
| CN | 103243782 A | * | 8/2013 | E03C 1/0402 |
| JP | H0893012 A | * | 4/1996 | E03C 1/0402 |

* cited by examiner

*Primary Examiner* — Erin Deery

(57) ABSTRACT

The present disclosure provides a locking mechanism for installing a faucet above a countertop, including a water outlet assembly, a bottom plate assembly engaged with and mounted to the water outlet assembly, and at least one locking block slidably and operably arranged on the bottom plate assembly; an installation hole with a diameter smaller than the length of the locking block is provided on the countertop; the locking block, being inclined with the countertop, can pass through the installation hole; when the locking block, being inclined with the pinch plate, passes through the positioning hole and the installation hole in sequence and flips to a horizontal state, the bolt is screwed to control the locking block to slide upward and jack up to press the countertop until contacting the bottom plate assembly, so that the countertop is clamped and locked between the bottom plate assembly and the locking block.

8 Claims, 10 Drawing Sheets

LOCKING MECHANISM FOR INSTALLING FAUCET ABOVE COUNTERTOP

TECHNICAL FIELD

The present disclosure relates to a locking mechanism for installing a faucet above a countertop.

BACKGROUND

In the traditional installation process of a water outlet assembly of a faucet, it is usually necessary to operate below a countertop or install components to be installed to the water outlet assembly of the faucet from below the countertop.

This installation method operated from below the countertop creates blind spots for an operator, making the installation process laborious and inconvenient.

SUMMARY

The present disclosure provides a locking mechanism for installing a faucet above a countertop, which can effectively solve the above-mentioned problem.

The present disclosure is implemented as follows:

A locking mechanism for installing a faucet above a countertop includes a water outlet assembly, a bottom plate assembly engaged with and mounted to the water outlet assembly, and at least one locking block slidably and operably arranged on the bottom plate assembly;

The bottom plate assembly includes a pinch plate, and the locking block is slidably and operably arranged on the pinch plate; The pinch plate is provided with a positioning hole with a diameter smaller than the length of the locking block, the positioning hole corresponds to an installation hole on the countertop, and the locking block, being inclined with the pinch plate, can pass through the positioning hole;

A fixing base corresponding to the locking block is set to abut against and contact an upper edge surface of the positioning hole, an alignment pin is inserted into a through hole of the fixing base, a bolt is inserted into an insertion hole of the fixing base, and the locking block is provided with a locking hole for inserting the alignment pin and a screw hole in a threaded connection with the bolt;

The installation hole with a diameter smaller than the length of the locking block is provided on the countertop; the locking block, being inclined with the countertop, can pass through the installation hole; when the locking block, being inclined with the pinch plate, passes through the positioning hole and the installation hole in sequence and flips to a horizontal state, the bolt is screwed to control the locking block to slide upward and jack up to press the countertop until contacting the bottom plate assembly, so that the countertop is clamped and locked between the bottom plate assembly and the locking block.

As a further improvement, the water outlet assembly includes a housing, the upper end surface edge of the pinch plate has a step surface for locking and engaging with the housing; a mounting hole is opened and penetrates through the back side of the housing, and an actuating block operably matched with the mounting hole is slidably equipped on the pinch plate; when the actuating block slides to be inserted into the mounting hole, the housing is locked and installed on the pinch plate; when the actuating block slides to be separated from the mounting hole, the housing can be lifted upward and removed from the pinch plate.

As a further improvement, two sets of vertical plates are fixedly arranged at intervals on the upper end surface of the pinch plate along the left-right direction, each set of vertical plates includes two vertical plates fixedly arranged at intervals on the pinch plate along the front-back direction, the bottom plate assembly further includes a locking plate, a latch, and a spring; the locking plate is slidably operative between the two vertical plates arranged along the front-back direction, the actuating block is fixedly arranged in the middle position of the front end of the locking plate, the latch is inserted into pin holes of the two vertical plates arranged along the front-back direction, through holes are opened on both sides of the locking plate and slidably matched with the latch, and the spring is sleeved around the latch to provide the locking plate with a forward sliding tendency to drive the actuating block to be inserted into the mounting hole.

As a further improvement, the upper end surface of the locking block in contact with the countertop is provided with an anti-slip pattern, and the upper end surface of the locking block is embedded with a rubber pad.

As a further improvement, at least one anchor hole is opened on the front inner wall of the housing, a hook portion that is hooked and anchored with the anchor hole is fixedly arranged on the side of the upper end surface of the pinch plate corresponding to the actuating block, and the hook portion has elastic deformation capacity.

As a further improvement, a rubber ring is embedded at the lower end surface edge of the pinch plate contacting the countertop.

As a further improvement, the water outlet assembly further includes a water outlet nozzle installed on the housing, a valve core and a water pipe communicated with the water outlet nozzle, the end of the water pipe is sealed and inserted into the water inlet end of the valve core, and at least two sealing rings are arranged at intervals between the outer side of the end of the water pipe and the inner wall of the water inlet end of the valve core.

As a further improvement, a switch for controlling faucet functions is installed on the outside of the housing.

The beneficial effects of the present disclosure are as follows.

The present application has the advantages of simple structure and easy and quick installation. The faucet can be quickly installed through clamping the countertop by the pinch plate and the locking block, which greatly facilitates the installation process of the faucet above the countertop. An operator does not need to operate under the countertop during installation, and no blind spots exist.

Figure 1:
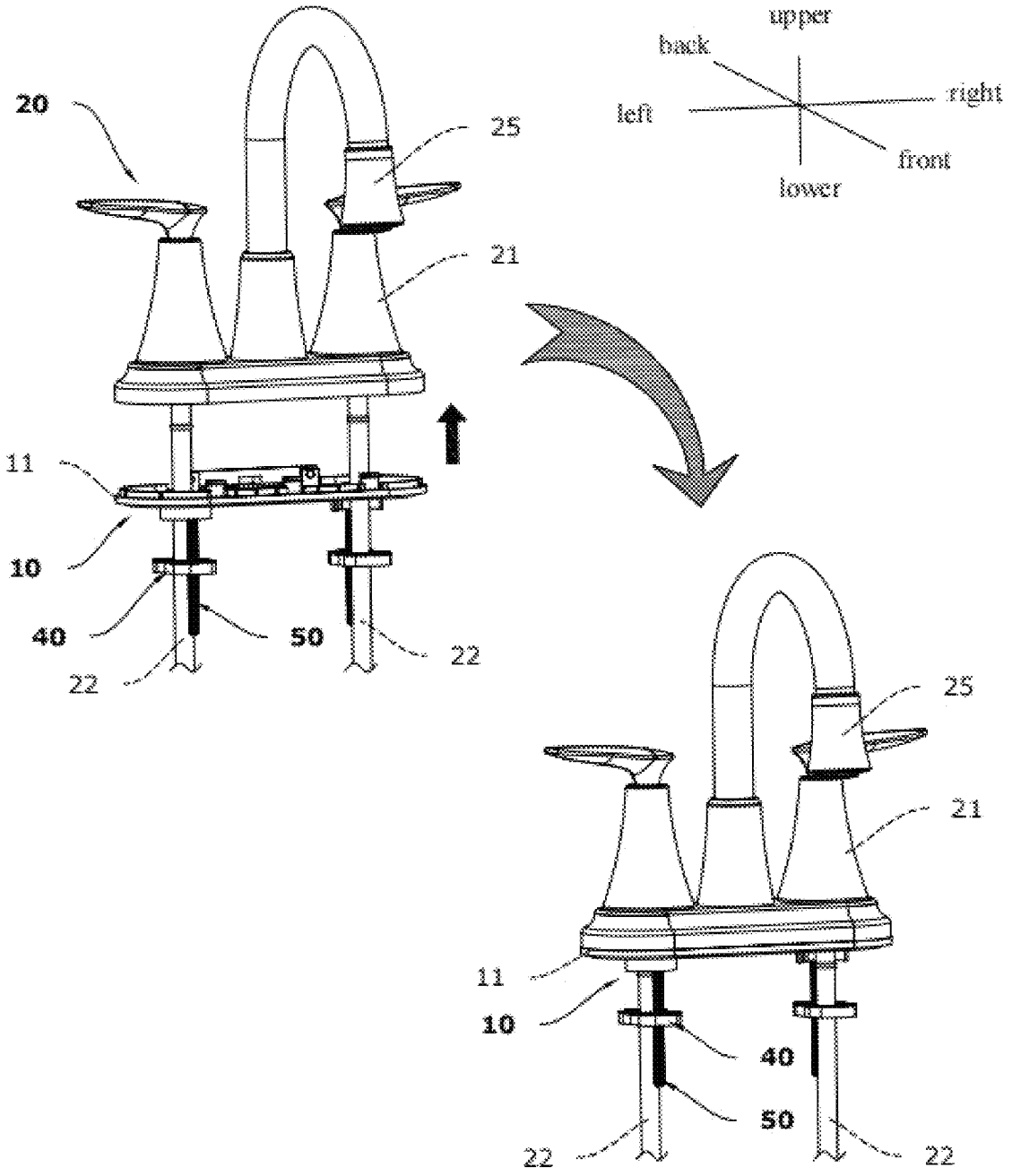
FIG. 1 is a schematic diagram showing the overall structure of the present disclosure.

10, bottom plate assembly;
11, pinch plate;
111, positioning hole;
112, step surface;
113, rubber ring;
12, locking plate;
121, actuating block;
122, through hole;
13, vertical plate;
131, pin hole;
14, latch;
15, spring;
16, hook portion;
20, water outlet assembly;
21, housing;
211, mounting hole;
212, anchor hole;
123, switch;
22, water pipe;
23, valve core;
24, sealing ring;
25, water outlet nozzle;
30, fixing base;
31, through hole;
32, insertion hole;
40, locking block;
41, locking hole;
42, screw hole;
43, anti-slip pattern;
44, rubber pad;
50, bolt;
51, alignment pin;
100, countertop;
101, installation hole.

DETAILED DESCRIPTION OF THE EMBODIMENTS

The present disclosure will be further illustrated in conjunction with the accompanying drawings and embodiments.

As shown in FIG. 1 to FIG. 5, a locking mechanism for installing a faucet above a countertop includes a water outlet assembly 20, a bottom plate assembly 10 engaged with and mounted to the water outlet assembly 20, and at least one locking block 40 slidably and operably arranged on the bottom plate assembly 10. The bottom plate assembly 10 includes a pinch plate 11, and the locking block 40 is slidably and operably arranged on the pinch plate 11. The pinch plate 11 is provided with a positioning hole 111 with a diameter smaller than the length of the locking block 40, and the positioning hole 111 corresponds to an installation hole 101 on the countertop 100. The locking block 40, being inclined with the pinch plate 11, can pass through the positioning hole 111. A fixing base 30 corresponding to the locking block 40 is set to abut against and contact the upper edge surface of the positioning hole 111. An alignment pin 51 is inserted into a through hole 31 of the fixing base 30, and a bolt 50 is inserted into an insertion hole 32 of the fixing base 30. The locking block 40 is provided with a locking hole 41 for inserting the alignment pin 51 and a screw hole 42 in a threaded connection with the bolt 50. The installation hole 101 with a diameter smaller than the length of the locking block 40 is provided on the countertop 100. The locking block 40, being inclined with the countertop 100, can pass through the installation hole 101.

When the locking block 40, being inclined with the pinch plate 11, passes through the positioning hole 111 and the installation hole 101 in sequence and flips to a horizontal state, the bolt 50 is screwed to control the locking block 40 to slide upward and jack up to press the countertop 100 until contacting the bottom plate assembly 10, so that the countertop 100 is clamped and locked between the bottom plate assembly 10 and the locking block 40.

In this embodiment, two locking blocks 40 are provided on one pinch plate 11. In other embodiments, the number of the locking blocks 40 can be adaptively adjusted to one, three, or even more according to the length and the fixing strength of the pinch plate 11.

When the alignment pin 51 passes through the through hole 31 and is inserted into the locking hole 41 in sequence, the insertion hole 32 is aligned with the screw hole 42. The bolt 50 passes through the insertion hole 32 on the fixing base 30 and is in a threaded connection with the screw hole 42 on the locking block 40, which, accordingly, can drive the locking block 40 to slide upward until the upper end surface of the locking block 40 contacts and presses against the bottom surface of the countertop 100, so that the water outlet assembly 20 and the bottom plate assembly 10 that are engaged and mounted together are locked and mounted on the countertop 100. In this application, operations can be directly performed above the countertop 100 with the help of tools, greatly facilitating the installation process of the faucet above the countertop 100. Installation personnel do not need to operate below the countertop 100 during installation, and no blind spots exist.

Hereinafter, the structure of each component of the present disclosure will be illustrated separately.

Figure 2:
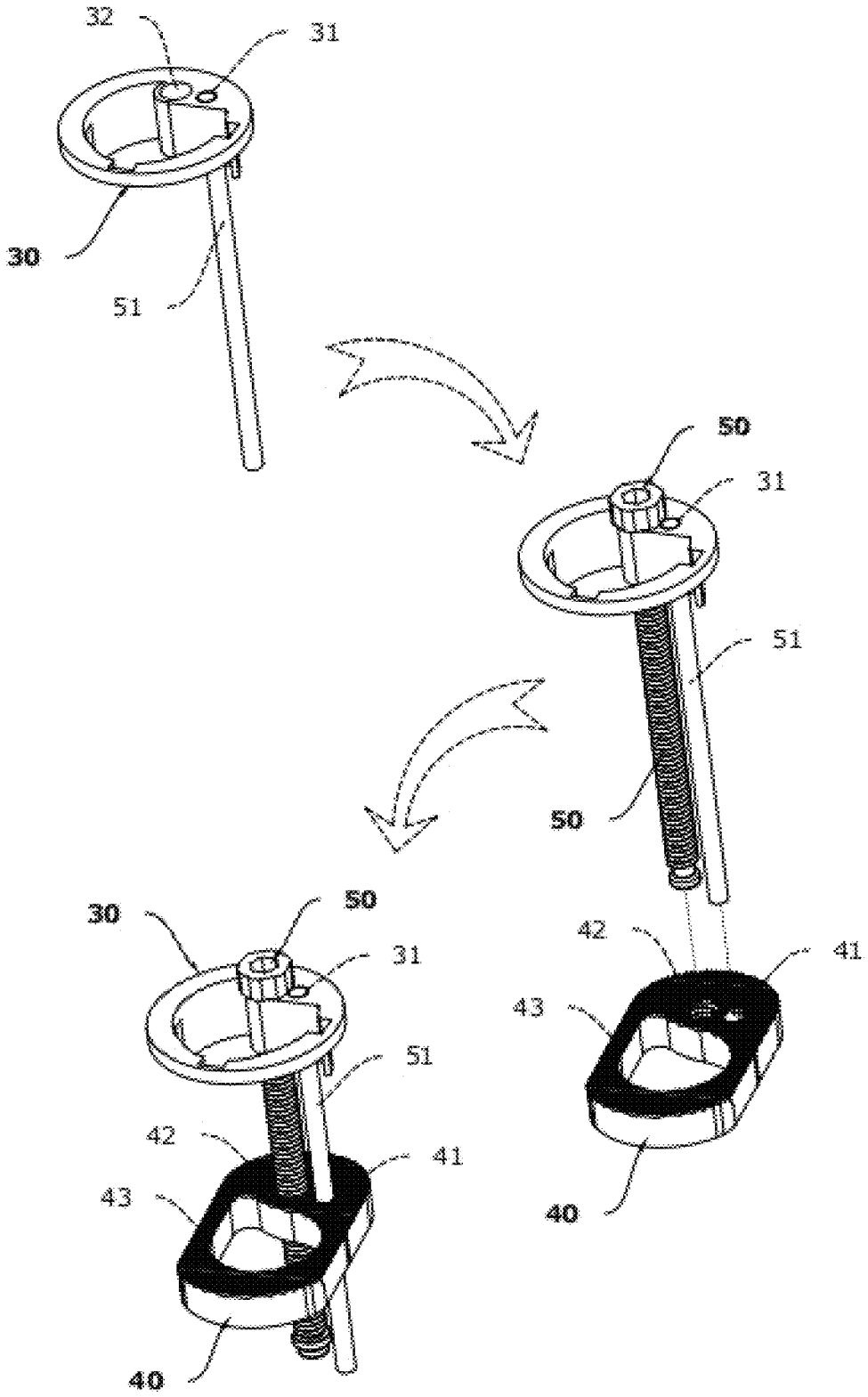
FIG. 2 is a schematic diagram showing a combined state where the fixing base and locking block are assembled according to the present disclosure.
Figure 3:
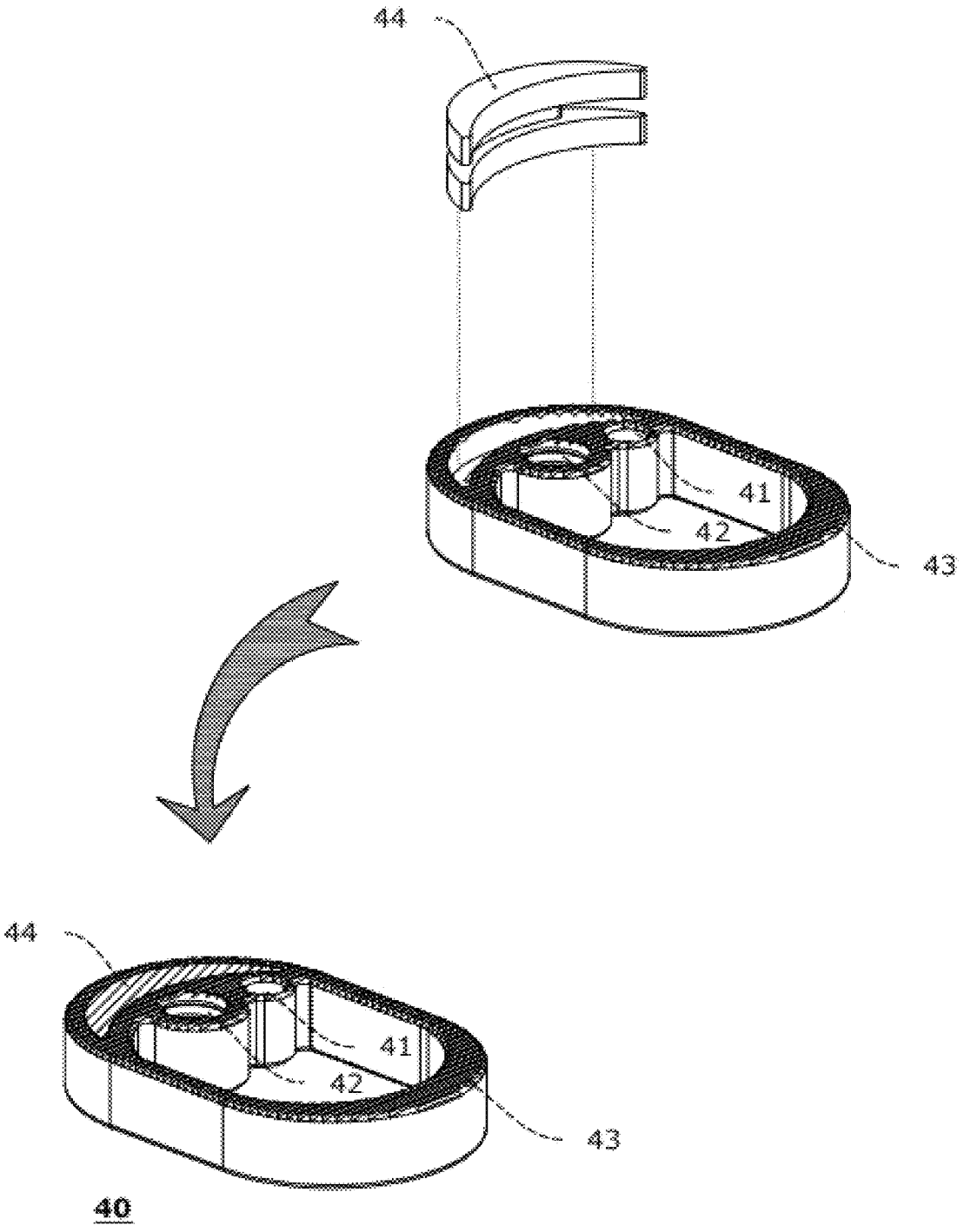
FIG. 3 is a schematic diagram showing the structure of the locking block according to the present disclosure.
Figure 4:
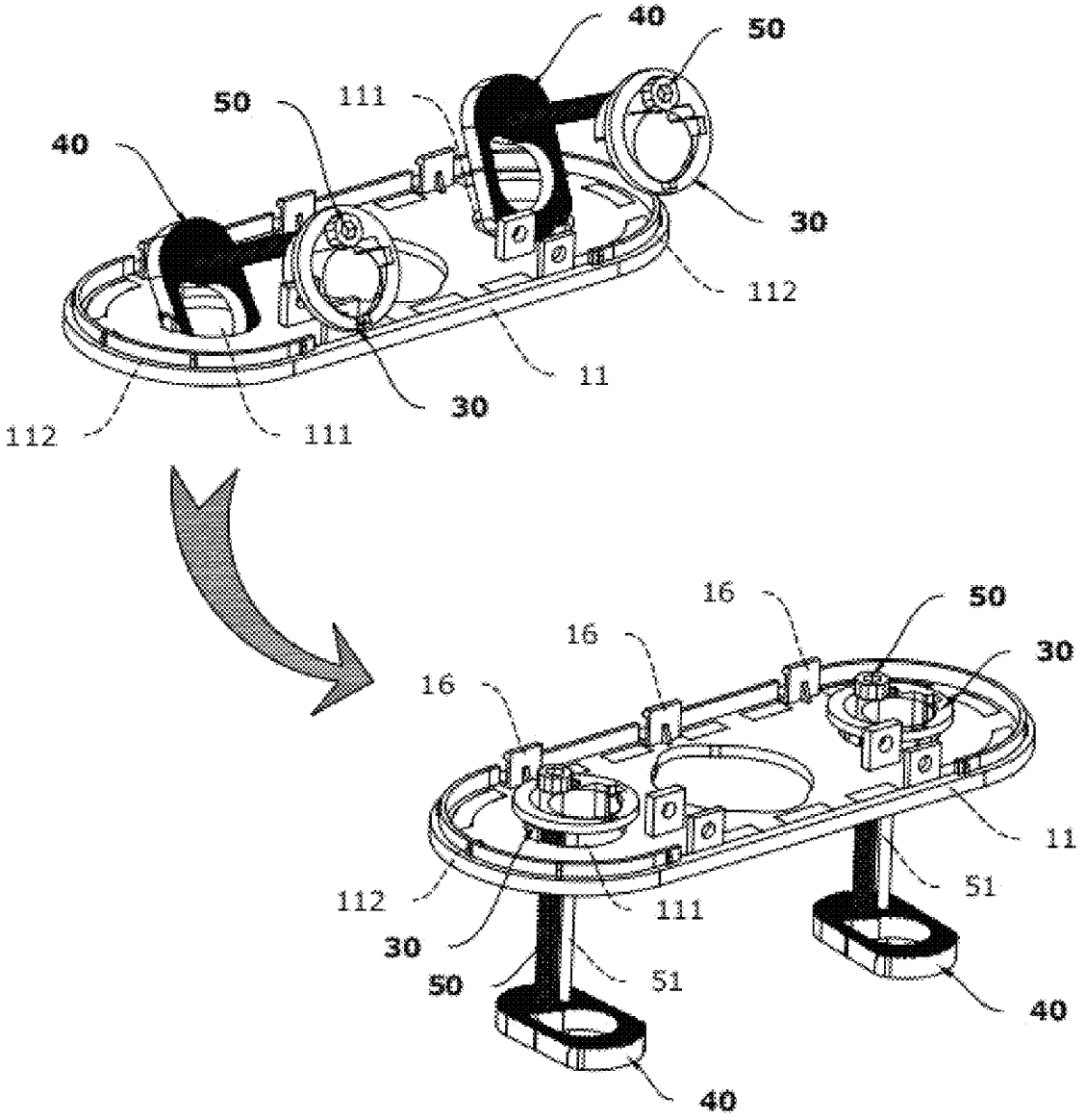
FIG. 4 is a schematic diagram showing the assembly where the locking block inclinedly passes through the positioning hole of the pinch plate according to the present disclosure.
Figure 5:
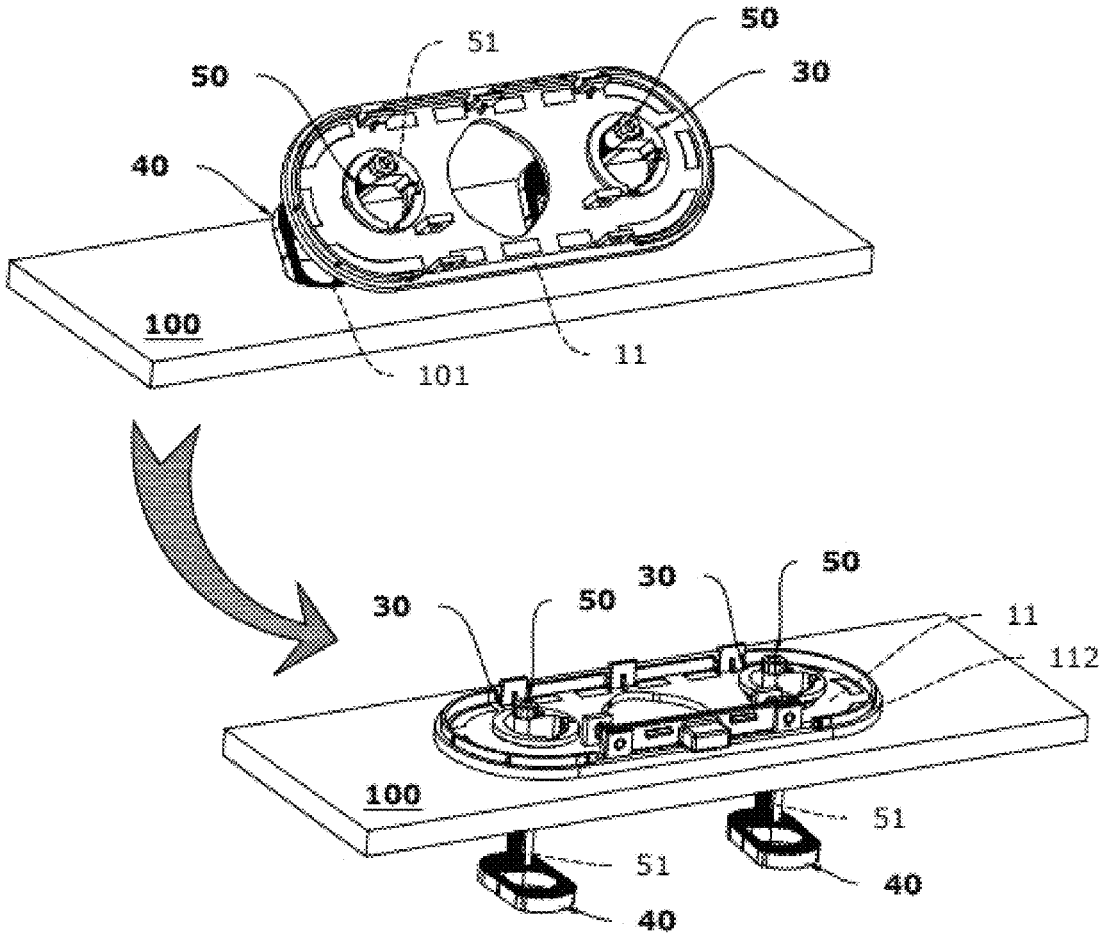
FIG. 5 is a schematic diagram showing the assembly where the locking block inclinedly passes through the installation hole of the countertop according to the present disclosure.

As shown in FIG. 2, FIG. 3, and FIG. 5, the upper end surface of the locking block 40 in contact with the countertop 100 is provided with an anti-slip pattern 43, and the upper end surface of the locking block 40 is embedded with a rubber pad 44. The rubber pad 44 is embedded on the upper end surface of the locking block 40 by injection molding. By adding the anti-slip pattern 43 and the rubber pad 44, the friction between the locking block 40 and the bottom surface of the countertop 100 can be increased, thereby enhancing the anti-detachment capacity of the locking block 40 and greatly improving the installation stability of the faucet.

Figure 6:
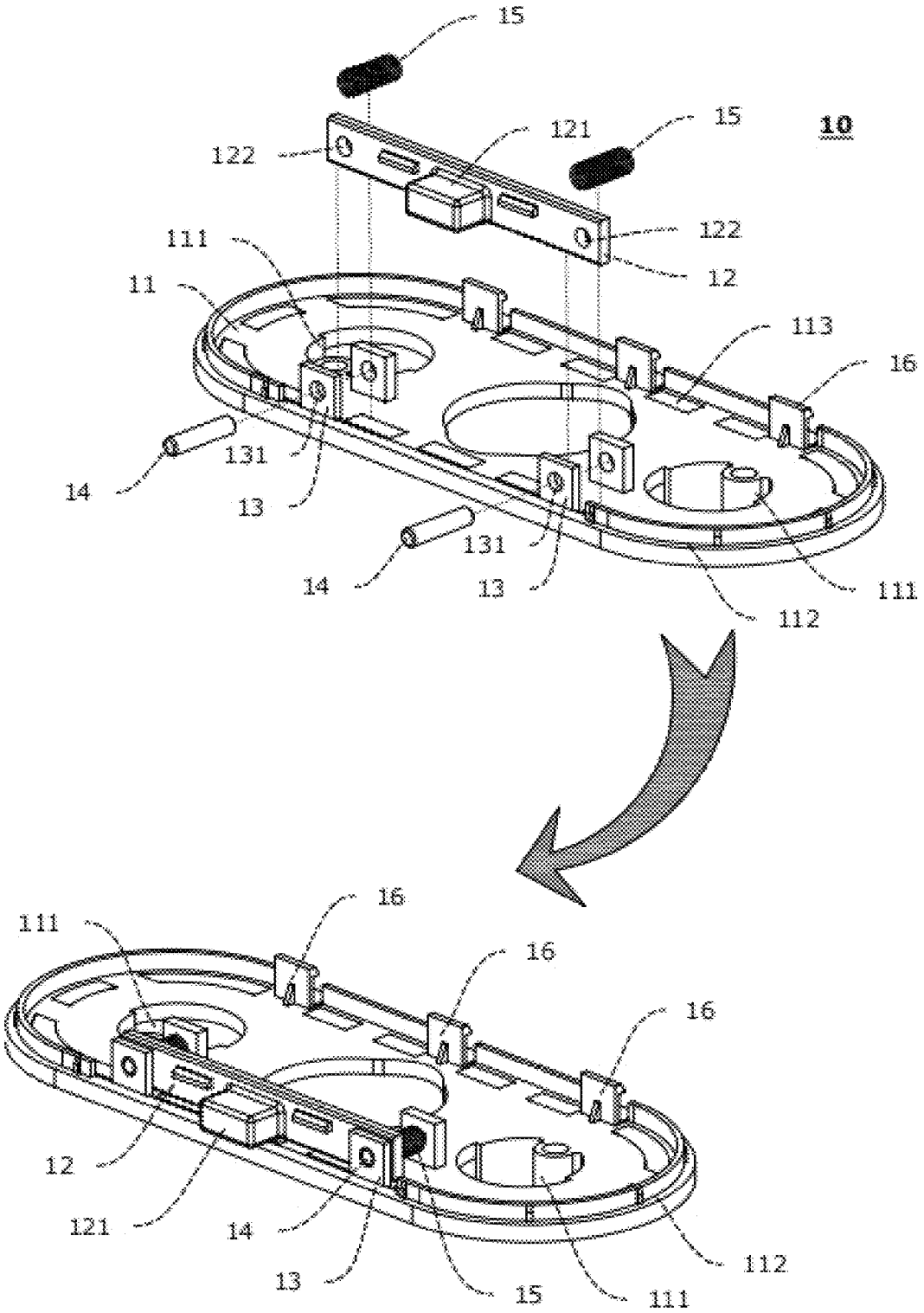
FIG. 6 is a schematic diagram showing the assembly of various components of the bottom plate assembly according to the present disclosure.
Figure 7:
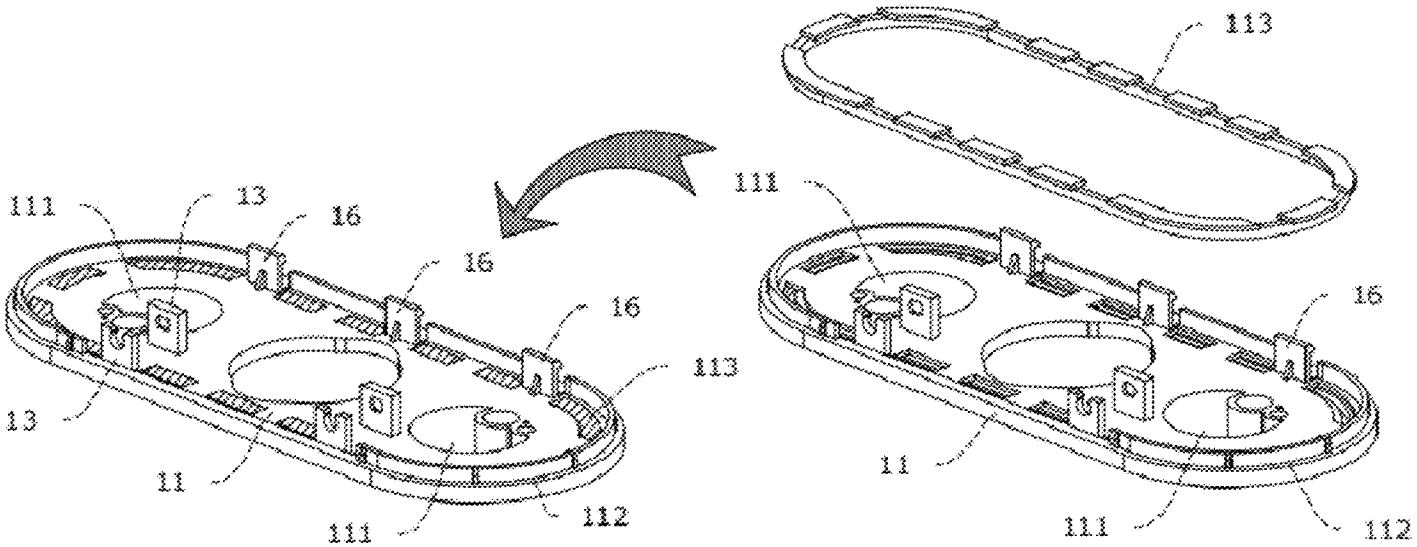
FIG. 7 is a schematic diagram showing the assembly of the rubber ring and the pinch plate according to the present disclosure.
Figure 8:
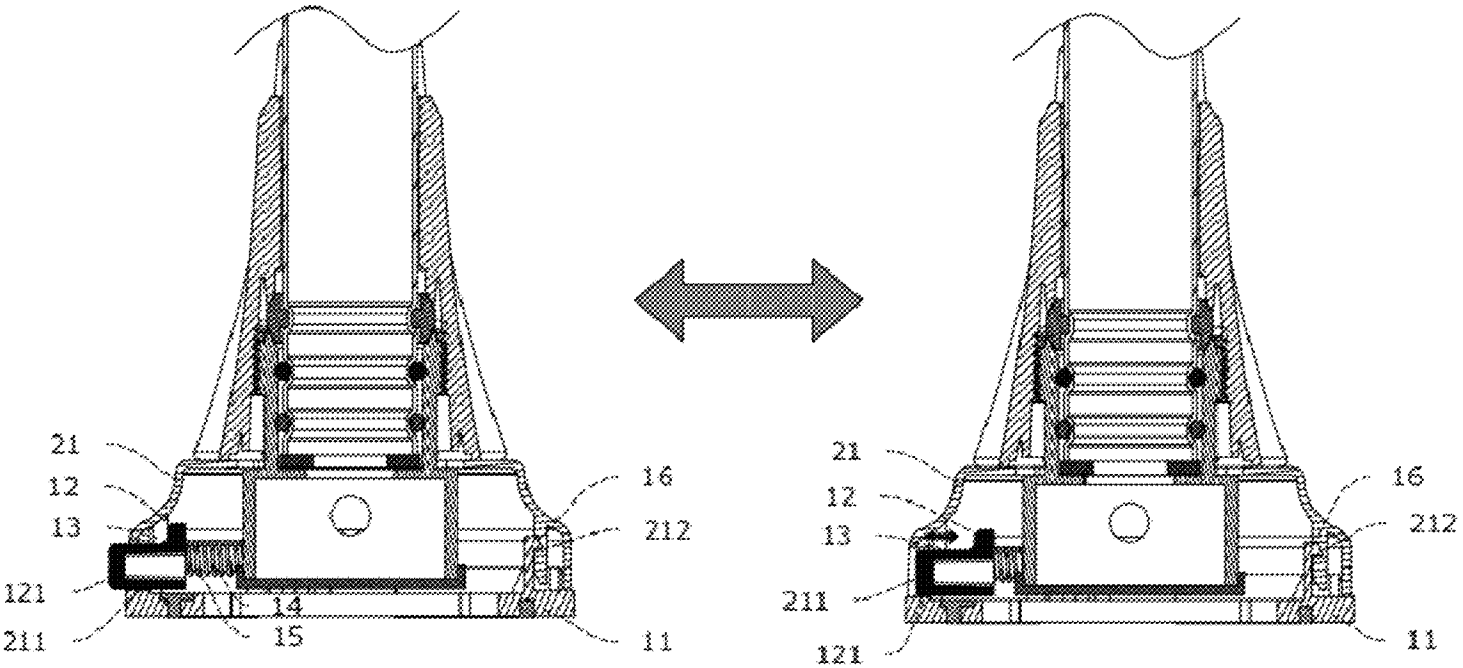
FIG. 8 is a schematic diagram showing the actuating block inserted into and separated from the mounting hole according to the present disclosure.

As shown in FIG. 6, FIG. 7, and FIG. 8, the water outlet assembly 20 includes a housing 21. The upper end surface edge of the pinch plate 11 has a step surface 112 for locking and engaging with the housing 21. A mounting hole 211 is opened and penetrates through the back side of the housing 21, and an actuating block 121 operably matched with the mounting hole 211 is slidably equipped on the pinch plate 11. When the actuating block 121 slides to be inserted into the mounting hole 211, the housing 21 is locked and installed on the pinch plate 11; when the actuating block 121 slides to be separated from the mounting hole 211, the housing 21 can be lifted upward and removed from the pinch plate 11.

As shown in FIG. 6 and FIG. 7, two sets of vertical plates 13 are fixedly arranged at intervals on the upper end surface of the pinch plate 11 along the left-right direction, and each set of vertical plates 13 includes two vertical plates 13 fixedly arranged at intervals on the pinch plate 11 along the front-back direction. The bottom plate assembly 10 further includes a locking plate 12, a latch 14, and a spring 15; the locking plate 12 is slidably operative between the two vertical plates 13 arranged along the front-back direction, the actuating block 121 is fixedly arranged in the middle position of the front end of the locking plate 12, and the latch 14 is inserted into pin holes 131 of the two vertical plates 13 arranged along the front-back direction. Through holes 122 are opened on both sides of the locking plate 12 and slidably matched with the latch 14, and the spring 15 is sleeved around the latch 14 to provide the locking plate 12 with a forward sliding tendency to drive the actuating block 121 to be inserted into the mounting hole 211. At least one anchor hole 212 is opened on the front inner wall of the housing 21, and a hook portion 16 that is hooked and anchored with the anchor hole 212 is fixedly arranged on the side of the upper end surface of the pinch plate 11 corresponding to the actuating block 121, and the hook portion 16 has elastic deformation capacity.

As shown in FIG. 5 and FIG. 7, a rubber ring 113 is embedded at the lower end surface edge of the pinch plate 11 contacting the countertop 100. The rubber ring 113 is embedded on the lower end surface of the pinch plate 11 by injection molding. Such a design can enhance the friction between the pinch plate 11 and the countertop 100 and prevent the pinch plate 11 from shifting relative to the countertop 100 during use, achieving an anti-detachment effect. In addition, since the lower end surface of the pinch plate 11 is wrapped by the rubber ring 113, during use, liquid can also be prevented from penetrating between the housing 21 and the pinch plate 11, thereby playing a waterproof role.

Figure 9:
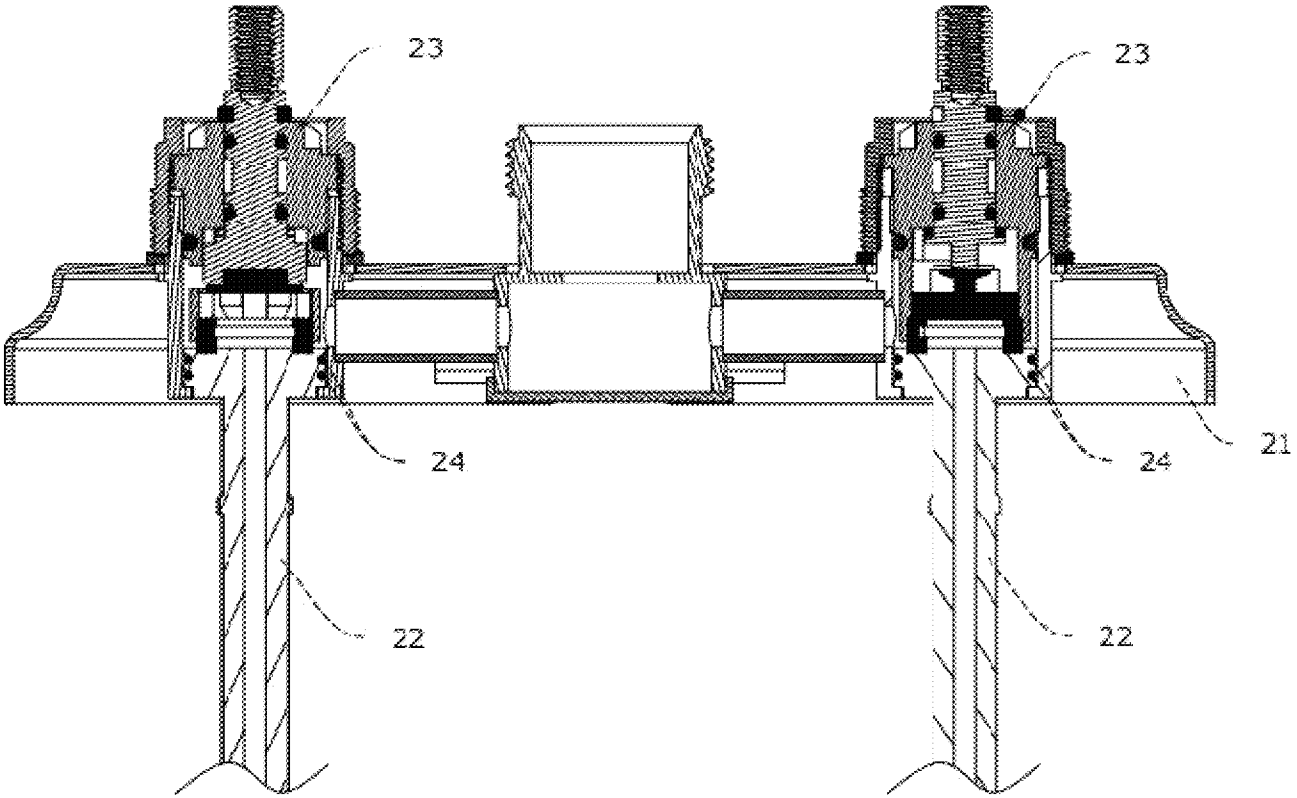
FIG. 9 is a cross-sectional view showing the assembly of the water pipe and the valve core according to the present disclosure.

As shown in FIG. 1 and FIG. 9, the water outlet assembly 20 further includes a water outlet nozzle 25 installed on the housing 21, a valve core 23 and a water pipe 22 communicated with the water outlet nozzle 25. The end of the water pipe 22 is sealed and inserted into the water inlet end of the valve core 23. At least two sealing rings 24 are arranged at intervals between the outer side of the end of the water pipe 22 and the inner wall of the water inlet end of the valve core 23. Such a design can enhance the sealing performance of the installation between the water pipe 22 and the valve core 23 and reduce the possibility of water leakage during the use of the faucet.

Another Embodiment of the Present Application

Figure 10:
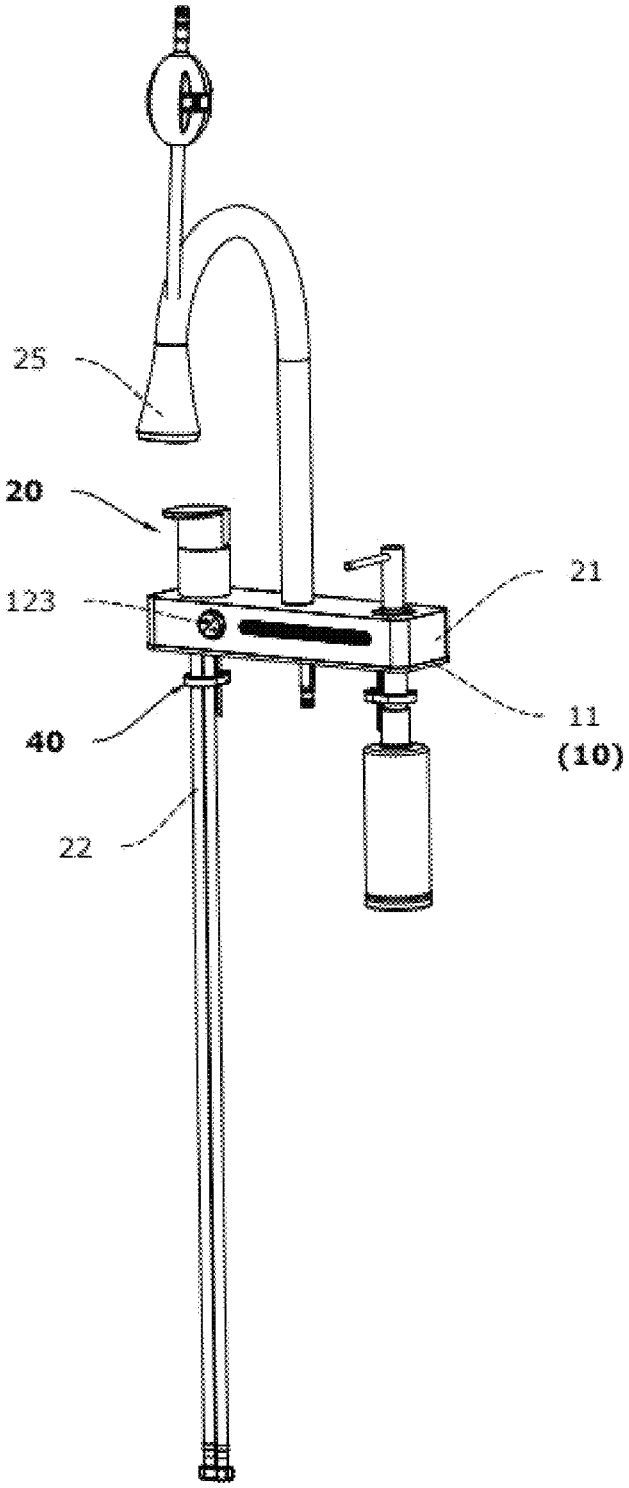
FIG. 10 is a schematic diagram showing the overall structure of another embodiment of the present disclosure.

As shown in FIG. 10, a switch 123 for controlling faucet functions is installed on the outside of the housing 21. A user can adjust and switch the faucet water path, water temperature, and other functions according to usage requirements. The switch can also be used to control the opening and closing, liquid output, etc. of a soap bottle installed on the faucet to increase the diversity of the faucet's usage functions.

The working principle of the present disclosure as well as the assembly and disassembly of the faucet above the countertop 100 by using the present disclosure will be described in detail with reference to FIG. 1 to FIG. 9.

When installing the faucet, the alignment pin 51 is allowed to pass through the through hole 31 on the fixing base 30 and be inserted into the locking hole 41 on the locking block 40, and then the bolt 50 is allowed to pass through the insertion hole 32 on the fixing base 30 and be threaded with the screw hole 42 on the locking block 40. The locking block 40 is allowed to sequentially pass, in a state of being inclined with the pinch plate, through the positioning hole 111 on the pinch plate 11 and the installation hole 101 on the countertop 100, and then the bolt 50 is screwed with the help of a tool to control the locking block 40 to move upward to abut against the lower end surface of the pinch plate 11 (the lower edge surface of the installation hole 101), such that the countertop 100 is clamped between the pinch plate 11 and the locking block 40. Then, the actuating block 121 is pressed and driven to move backward to be longitudinally misaligned with the mounting hole 211 on the housing 21, and the housing 21 is pushed downward to be engaged into the step surface 112 of the pinch plate 11. At this time, the locking plate 12 slides forward under the action of the spring 15 to enable the actuating block 121 to be inserted into the mounting hole 211. During this process, the hook portion 16 is hooked and anchored with the anchor hole 212, thereby completing the rapid installation of the faucet above the countertop 100.

When disassembling the faucet, the actuating block 121 is pressed until it is completely separated from the mounting hole 211, then the housing 21 is pushed backward to separate the hook portion 16 from the anchor hole 212, at this time, the housing 21 can be lifted upward and removed from the pinch plate 11, next, the bolt 50 is loosened until the locking block 40 is separated from the bolt 50 and the alignment pin 51, as a result, the locking block 40 and the bottom plate assembly 10 can be removed from the countertop 100 in sequence.

The above embodiments are only for the purpose of illustrating the present disclosure, and are not intended to limit the present disclosure. Those skilled in the art can make various changes or modifications without departing from the spirit and scope of the present disclosure. Therefore, all equivalent technical solutions should also belong to the scope of the present disclosure and be defined by the claims.

The invention claimed is:

1. A locking mechanism for installing a faucet above a countertop, comprising a water outlet assembly, a bottom plate assembly engaged with and mounted to the water outlet assembly and at least one locking block slidably and operably arranged on the bottom plate assembly; wherein the bottom plate assembly comprises a pinch plate, and the locking block is slidably and operably arranged on the pinch plate; the pinch plate is provided with a positioning hole with a diameter smaller than a length of the locking block, the positioning hole corresponds to an installation hole on the countertop, and the locking block, when inclined with respect to the pinch plate, is configured to pass through the positioning hole;

a fixing base corresponding to the locking block is set to abut against and contact an upper edge surface of the positioning hole, an alignment pin is inserted into a through hole of the fixing base, a bolt is inserted into an insertion hole of the fixing base, and the locking block is provided with a locking hole for inserting the alignment pin and a screw hole in a threaded connection with the bolt;

the installation hole with a diameter smaller than the length of the locking block is provided on the countertop; the locking block, when inclined with respect to the countertop, is configured to pass through the installation hole; when the locking block inclined with respect to the pinch plate passes through the positioning hole and the installation hole in sequence and is positioned in a horizontal state, the bolt is screwed to control the locking block to move upward and contact a bottom surface of the countertop, so that the countertop is clamped and locked between the bottom plate assembly and the locking block.

2. The locking mechanism for installing the faucet above the countertop according to claim 1, wherein the water outlet assembly comprises a housing, an upper end surface edge of the pinch plate has a step surface for locking and engaging with the housing; a mounting hole is opened and penetrates through a back side of the housing, and an actuating block operably matched with the mounting hole is slidably equipped on the pinch plate; when the actuating block slides to be inserted into the mounting hole, the housing is locked and installed on the pinch plate; when the actuating block slides to be separated from the mounting hole, the housing is capable of being lifted upward and removed from the pinch plate.

3. The locking mechanism for installing the faucet above the countertop according to claim 2, wherein two sets of vertical plates are fixedly arranged at intervals on an upper end surface of the pinch plate along a left-right direction, each set of vertical plates comprises two vertical plates fixedly arranged at intervals on the pinch plate along a front-back direction, the bottom plate assembly further comprises a locking plate, a latch, and a spring; the locking plate is slidably operative between the two vertical plates arranged along the front-back direction, the actuating block is fixedly arranged in a middle position of a front end of the locking plate, the latch is inserted into pin holes of the two vertical plates arranged along the front-back direction, through holes are opened on both sides of the locking plate and slidably matched with the latch, and the spring is disposed about the latch to bias the locking plate forwardly, thereby urging the actuating block to engage the mounting hole.

4. The locking mechanism for installing the faucet above the countertop according to claim 1, wherein an upper end surface of the locking block in contact with the countertop is provided with an anti-slip pattern, and the upper end surface of the locking block is embedded with a rubber pad.

5. The locking mechanism for installing the faucet above the countertop according to claim 2, wherein at least one anchor hole is provided on a front inner wall of the housing, a hook portion that is hooked and anchored with the anchor hole is fixedly arranged on a side of an upper end surface of the pinch plate corresponding to the actuating block, and the hook portion is resiliently deformable.

6. The locking mechanism for installing the faucet above the countertop according to claim 1, wherein a rubber ring is embedded at a lower end surface edge of the pinch plate contacting the countertop.

7. The locking mechanism for installing the faucet above the countertop according to claim 2, wherein the water outlet assembly further comprises a water outlet nozzle installed on the housing, a valve core and a water pipe communicated with the water outlet nozzle, an end of the water pipe is sealed and inserted into a water inlet end of the valve core, and at least two sealing rings are arranged at intervals between an outer side of the end of the water pipe and an inner wall of the water inlet end of the valve core.

8. The locking mechanism for installing the faucet above the countertop according to claim 2, wherein a switch for controlling faucet functions is installed on an outer side of the housing.

* * * * *